US006876136B2

(12) United States Patent
Nishibayashi et al.

(10) Patent No.: US 6,876,136 B2
(45) Date of Patent: Apr. 5, 2005

(54) ELECTRON EMISSION ELEMENT

(75) Inventors: Yoshiki Nishibayashi, Itami (JP); Yutaka Ando, Sagamihara (JP); Takahiro Imai, Itami (JP)

(73) Assignees: Sumitomo Electric Industries, Ltd., Osaka (JP); Japan Fine Ceramics Center, Aichi (JP)

( * ) Notice: Subject to any disclaimer, the term of this patent is extended or adjusted under 35 U.S.C. 154(b) by 21 days.

(21) Appl. No.: 10/660,633

(22) Filed: Sep. 12, 2003

(65) Prior Publication Data

US 2004/0056580 A1 Mar. 25, 2004

(30) Foreign Application Priority Data

Sep. 20, 2002 (JP) ..... P2002-276391

(51) Int. Cl.[7] ..... H01J 19/24

(52) U.S. Cl. ..... 313/309; 313/311; 313/336; 313/351; 313/326; 313/346 R; 313/495

(58) Field of Search ..... 313/308–311, 326, 313/346 R, 355, 495–497, 336, 351; 357/10–12, 102; 257/10, 11, 77; 156/657.1, 662.1, 643.1, 657, 662, 643

(56) References Cited

U.S. PATENT DOCUMENTS 6,465,941 B1 * 10/2002 Kubota et al. ..... 313/309

FOREIGN PATENT DOCUMENTS

JP P2001-266736 9/2001

* cited by examiner

*Primary Examiner*—Joseph Williams
*Assistant Examiner*—Sharlene Leurig
(74) *Attorney, Agent, or Firm*—McDermott Will & Emery LLP

(57) ABSTRACT

An electron emission element according to the present invention comprises a substrate, and a plurality of protrusions composed of diamond and protruding from the substrate. Each protrusion includes a columnar portion, the side face of which forms an inclination of approximately 90° relative to the surface of the substrate, and a tip portion, which is located on the columnar portion having a spicular end. A conductive layer is formed on the upper part of each columnar portion, and a cathode electrode film, which is electrically connected to the conductive layer, is formed on the side face of the columnar portion.

10 Claims, 18 Drawing Sheets

SHARP EMITTER WITH AN AL ELECTRODE

SHARP EMITTER
WITH AN Al ION INJECTED LAYER

PROTRUSION WHERE AN Al ELECTRODE
IS FORMED EXCEPT FOR THE TIP

SHARP EMITTER INCLUDING
A BORON DOPED EPITAXIAL LAYER

PROTRUSION WHERE AN AL ELECTRODE IS FORMED EXCEPT FOR THE END PORTION

ELECTRON EMISSION CHARACTERISTIC
OF A SHARP EMITTER INCLUDING
AN Al ION INJECTED LAYER
AND BEING PLOVIDED WITH AN Al ELECTRODE

ELECTRON EMISSION CHARACTERISTIC
OF A SHARP EMITTER INCLUDING
A BORON DOPED EXITAXIAL LAYER
AND BEING PROVIDED WITH AN AL ELECTRODE

ELECTRON EMISSION ELEMENT

BACKGROUND OF THE INVENTION

1. Field of the Invention

The present invention relates to electron emission elements composed of diamonds.

2. Related Background Art

A conventional electron emission element is disclosed in Japanese Patent Application Laid-Open No. 2001-266736, wherein a metal layer is formed around a diamond protrusion having a quadrangular pyramid shape.

SUMMARY OF THE INVENTION

However, according to the above prior art, the efficiency in which electrons from a cathode electrode film are supplied to an electron emission section was not satisfactory.

In view of this problem, the objective of the present invention is to provide an electron emission element with which electrons from a cathode electrode film can be efficiently supplied to an electron emission section.

The electron emission element of this invention is characterized in comprising, a substrate, and a plurality of protrusions, composed of diamond, protruding from the substrate: wherein each of the protrusions comprises, a tip portion, having a sharp end, which is located at the top end of the protrusion, and a columnar portion, the side face of which extends upward relative to the surface of the substrate, and which is located below the tip portion; and wherein side face of each of the columnar portions of the protrusions is provided with a cathode electrode film, which is electrically connected to a conductive layer included in the protrusion.

Since the cathode electrode film formed on the side face of the columnar portion (a variety of columniform shapes, such as cylinders, prisms, truncated cones or pyramids, are conceived) is also extending upward relative to the surface of the substrate, free electrons in the cathode electrode film are attracted to the tip portion along the direction of the electric field. As a result, the electrons are supplied from the cathode electrode film to the protrusion at a portion close to the electron emission point (the sharp end of the tip portions, or a plurality of spicular members). Thus, the electrons from the cathode electrode film can be efficiently supplied to the electron emission point.

It is preferable, for the electron emission element of the present invention, that angles formed by the surface of the substrate and the side faces of the columnar portions are substantially right.

The most distinguishing effect can be obtained for attracting free electrons to the tip portion when the cathode electrode film extends in the substantially right direction relative to the surface of the substrate, i.e. the direction substantially parallel to the electric field.

It is preferable, for the electron emission element of the present invention, that the cathode electrode film covers both the protrusions and the surface of the substrate and, the area covering the surface of the substrate is larger than that covering the protrusions.

With such constitution of the cathode electrode film, preferable potential form is achieved for efficient emission of electrons from the tip portions.

It is preferable, for the electron emission element of the present invention, that the cathode electrode film covers entire side face of the columnar portion.

Since the area wherein the protrusion contacts the cathode electrode film is increased, the electrons from the cathode electrode film can be supplied with further efficiency to the electron emission section.

It is preferable, for the electron emission element of the present invention, that at least part of the conductive layer is included in the tip portion.

With this configuration electrons can move to the electron emission section inside the tip portions. As a result, further efficiency in supply of electrons from the cathode electrode film to the electron emission section is achieved.

It is preferable, for the electron emission element of the present invention, that the conductive layer is formed with diamond wherein metal ions are injected.

By injecting metal ions, a conductive layer in a desirable shape can be easily formed within diamond.

It is preferable, for the electron emission element of the present invention, that the conductive layer is formed with diamond wherein impurities are contained.

By making impurities be contained into the diamond, various types of conductive layers can be formed, and the emitter (protrusions) having a conductive layer with a desirable shape can be formed.

For the electron emission element of the present invention, it is preferable that the cathode electrode film include: a first cathode electrode layer that contacts the conductive layer; and a second cathode electrode layer that is formed on the first cathode electrode layer and that is thicker than the first cathode layer.

By reducing the film thickness of the first cathode electrode layer, a desirable shape can be easily made by etching. On the other hand, due to thinness of the film, disconnection tends to occur in the first cathode electrode layer. However, thick second cathode electrode layer electrically connects the disconnected part.

For the electron emission element of the present invention, it is preferable that an insulation film be formed on the cathode electrode film, and a second electrode film is formed on the insulation film.

The second electrode film can be utilized as a gate electrode for controlling the thickness of a depletion layer in the electron emission section.

DESCRIPTION OF THE PREFERRED EMBODIMENTS

The preferred embodiments of the present invention will be described in detail with reference to the attached drawings. Furthermore, same reference numbers are used throughout to denote the corresponding identical components, and duplicate explanations are omitted.

[First Embodiment]

Figure 1:
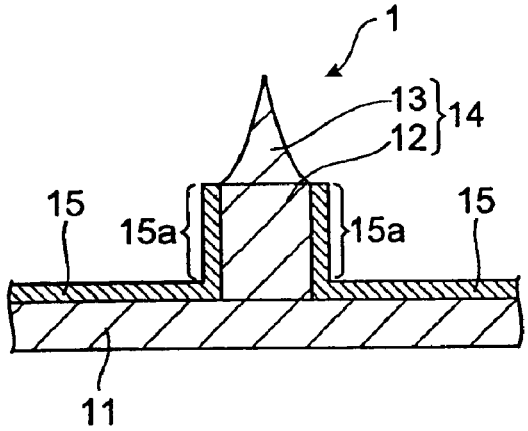
FIG. 1 is a vertical cross-sectional view of an electron emission element 1 according to a first embodiment of the present invention (Only one protrusion is shown for simplification)

The structure of an electron emission element 1 according to a first embodiment of the present invention will be described. FIG. 1 shows a vertical cross-sectional view of the electron emission element 1. Only one protrusion is shown for simplification. The electron emission element 1 includes a substrate 11 composed of diamond, and diamond protrusions 14 protruding from the substrate 11. A columnar portion 12, which consists the lower part of the protrusion 14, is cylindrical form, whose side face is at a substantial right angle to the surface of the substrate 11. The upper part of the protrusion 14 is constituted of a tip portion 13 having a spicular tip. In the first embodiment, the entire protrusion 14 and substrate 11 are made conductive by doping with boron.

A cathode electrode film 15 made of Al is formed on substrate 11, and extends close to the boundary between the columnar portion 12 and the tip portion 13. In other words, the cathode electrode film 15 covers the surface of the substrate 11 and the entire side face of the columnar portion 12. On the other hand, the conductive diamond (p-type semiconductor diamond), is exposed at the tip portion 13. Since the side face of the columnar portion 12 is at a substantial right angle with the surface of the substrate 11, the portion (the emitter electrode portion 15*a*) of the cathode electrode film 15 that covers the columnar portion 12 is also at a substantial right angle relative to the surface of the substrate 11. Further, the intervals at which the protrusions 14 are placed are adjusted, so that the area (the flat electrode portion 15*c* (not numbered in FIG. 1)) of the cathode electrode film 15 that covers the surface of the substrate 11 is larger than the area of the emitter electrode portion 15*a*.

An anode electrode A (not shown) is located above the electrode emission element 1, facing the tip portion 13. When a negative voltage is applied to the cathode electrode film 15, electrons from the emitter electrode portion 15*a* are supplied to the protrusion 14. Electrons that reach the spicular tip of the tip portion 13 are emitted externally by the electric field between the anode electrode A and the tip portion 13.

Next, the action and effects by the electron emission element 1 will be described. Since the emitter electrode portion 15*a* stands at a substantial right angle relative to the surface of the substrate 11, free electrons at the emitter electrode portion 15*a* concentrates at the end close to the anode electrode A. As a result, the electrons can move easily from the electron concentrating portion to the protrusion 14, and are supplied to the protrusion 14 at the position close to the electron emission section. Thus, the supply of electrons from the emitter electrode portion 15*a* to the electron emission section is performed efficiently. In addition, since the emitter electrode portion 15*a* and the side face of the columnar portion 12 forms a large inclination relative to the surface of the substrate 11, the movement of electrons from the emitter electrode portion 15*a* to the protrusion 14 is not disturbed by the electric field between the cathode and anode. In view of achieving further efficiency in making electrons move from the emitter electrode portion 15*a* to the protrusion 14, the inclination of the emitter electrode portion 15*a* and the side face of the columnar portion 12 relative to the surface of the substrate 11 preferably exceeds 90° (in a recurvated state).

Since the emitter electrode portion 15*a* covers the entire side face of the columnar portion 12, the area whereat the emitter electrode portion 15*a* contacts the columnar portion 12 is increased. And it becomes difficult that electrons, which have moved to the columnar portion 12 from the end of the emitter electrode portion 15*a* close the anode electrode A, escapes toward the substrate 11. Therefore, further efficiency in supply of electrons from the emitter electrode portion 15*a* to the electron emission section can be achieved.

Since the area of the flat electrode portion 15*c* of the cathode electrode film 15 is larger than the area of the emitter electrode portion 15*a*, distribution of electrical field desirable for extracting elections from the spicular end of the tip portion 13 is formed. Further, a large number of electrons supplied to the substrate 11 along with the protrusion 14 make it difficult for electrons that have moved from the emitter electrode portion 15*a* to the columnar portion 12 to escape. As a result, further efficiency in supply of electrons from the emitter electrode portion 15*a* to the electron emission section can be achieved.

Since the conductive layer is extended to the tip portion 13, the electrons moved from the emitter electrode portion 15*a* to the columnar portion 12 easily flow to the spicular end of the tip portion 13, which is the electron emission section. Thus, further efficiency in the supply of electrons from the emitter electrode portion 15*a* to the electron emission section can be achieved.

Despite the electron emission portion of the protrusion 14 is acute, since the tip portion 13 is connected to the columnar portion 14 being thicker than the electron emission section, the heat caused in the electron emission section can easily escape toward the substrate 11, thereby preventing damage due to flow of a large electrical current.

[Second Embodiment]

Figure 2:
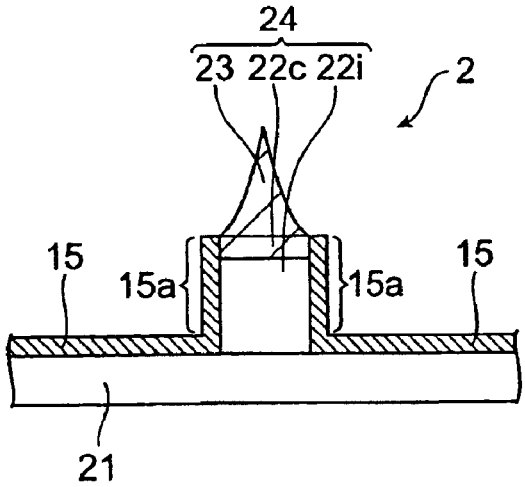
FIG. 2 is a vertical cross-sectional view of an electron emission element 2 according to a second embodiment of the present invention (Only one protrusion is shown for simplification)

The structure of an electron emission element 2 according to a second embodiment of the present invention will be described. FIG. 2 shows a vertical cross-sectional view of the electron emission element 2. Only one protrusion is shown for simplification. The electron emission element 2 comprises a substrate 21 composed of diamond, and a diamond protrusion 24 that protrudes from the substrate 21. A columnar portion 22, which constitutes the lower part of the protrusion 24, is cylindrical, whose side face is at a substantial right angle to the surface of the substrate 21. The upper part of the protrusion 24 is constituted of a tip portion 23 having a spicular tip.

In the second embodiment, the tip portion 23 and the upper part of the columnar portion 22 are made conductive by doping with boron. That is, the upper part of the columnar portion 22 is constituted of a conductive layer 22*c* made of a p-type semiconductor diamond, while the lower part of the columnar portion 22 is constituted of an insulation layer 22*i* composed of diamond wherein no impurities are doped.

A cathode electrode film 15 and an anode electrode A are composed as those in the first embodiment. An emitter electrode portion 15*a* contacts the conductive layer 22*c* of the columnar portion 22, and electrons are supplied to an electron emission section through this contact portion.

The same action and effects as those in the first embodiment can be obtained by the electron emission element 2. Further, electrons that have entered the conductive layer 22*c* are prevented from escaping toward the substrate 21 because the lower part is an insulation layer 22*i*. Therefore, further efficiency in supply of electrons from the emitter electrode portion 15*a* to the electron emission section can be achieved.

[Third Embodiment]

Figure 3:
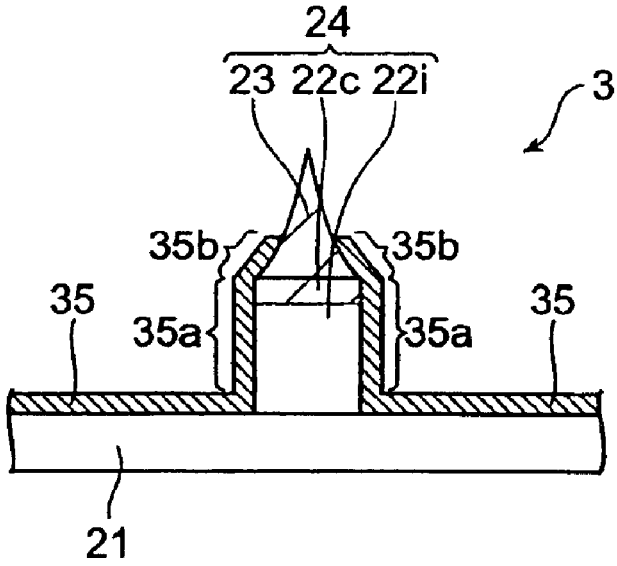
FIG. 3 is a vertical cross-sectional view of an electron emission element 3 according to a third embodiment of the present invention (Only one protrusion is shown for simplification)

The structure of an electron emission element 3 according to a third embodiment of the present invention will be described. FIG. 3 shows a vertical cross-sectional view of the electron emission element 3. Only one protrusion is shown for simplification. The structures of a substrate 21 and a protrusion 24 for the electron emission element 3 are the same as those in the second embodiment.

A cathode electrode film 35 made of Al is formed on substrate 21, and extends to the middle of a tip portion 23. In other words, the cathode electrode film 35 covers the surface of the substrate 21, the entire side face of a columnar portion 22 and the lower side face of the tip portion 23. Whereas a conductive diamond (p-type semiconductor diamond) is exposed at the upper side face of the tip portion 23. Since the side face of the columnar portion 22 is at a substantial right angle relative to the surface of the substrate 21, the part (the emitter electrode portion 35*a*) of the cathode electrode 35 that covers the columnar portion 22 is also at a substantial right angle relative to the surface of the substrate 21. A part of the cathode electrode film 35 above the emitter electrode portion 35*a* is a tilted electrode end 35*b* that inclines inward along the shape of the tip portion 23. In addition, the intervals between the protrusions 24 are adjusted so that the area (the flat electrode portion 35*c* (not numbered in FIG. 3)) of the cathode electrode film 35 that covers the surface of the substrate 21 is larger than the area of the emitter electrode portion 35*a* and the tilted electrode end 35*b*.

An anode electrode A (not shown) is located above the electron emission element 3 facing the tip portion 23. When a negative voltage is applied to the cathode electrode film 35, electrons are supplied from the emitter electrode portion 35*a* (the portion contacting the conductive layer 22*c*) and the tilted electrode end 35*b* to the protrusion 24. When the electrons reach the spicular tip of the tip portion 23, the electrons are externally emitted by the electric field between the anode electrode A and the tip portion 23.

The same action and effects as those in the first and second embodiments can be obtained by the electron emission element 3. Further, since a tilted electrode end 35*c* is provided, the protrusion 24 receives electrons not only from the conductive layer 22*c* of the columnar portion 22, but also from the lower part of the tip portion 23 close to the electron emission section. Therefore, further efficiency in supply of electrons from the cathode electrode 35 to the electron emission section can be achieved.

[Fourth Embodiment]

Figure 4:
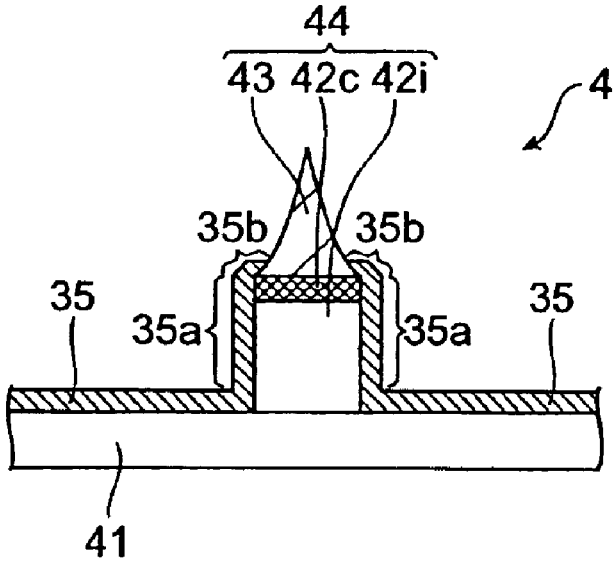
FIG. 4 is a vertical cross-sectional view of an electron emission element 4 according to a fourth embodiment of the present invention (Only one protrusion is shown for simplification)

The structure of an electron emission element 4 according to a fourth embodiment of the present invention will be described. FIG. 4 shows a vertical cross-sectional view of the electron emission element 4. Only one protrusion is shown for simplification. The electron emission element 4 comprises, a substrate 41 composed of diamond, and a diamond protrusion 44 that protrudes from the substrate 41. A columnar portion 42, which is the lower part of the protrusion 44, is cylindrical, whose side face is at a substantial right angle to the surface of the substrate 41. The upper part of the protrusion 44 is constituted of a tip portion 43 having a spicular tip.

In the fourth embodiment, a conductive layer 42*c* is formed on the upper part of columnar portion 42 by injecting metal ions. The metal ions accelerated in the ion injection process penetrate the surface layer of a diamond crystal layer, and after the kinetic energy is reduced to a certain level, the metal ions collide with carbon atoms at the depth of the conductive layer 42*c* and stops. With this impact, a defect occurs in the diamond crystal structure of the conductive layer 42*c*. Due to the defect in the diamond crystal and the formation of a metal layer, as a result, the conductive layer 42*c* is made conductive. The lower part (insulation layer 42*i*) of the columnar portion 42 and the tip portion 43 are composed of insulation diamond.

A cathode electrode film 35 and an anode electrode A have the same structure as those in the third embodiment. And an emitter electrode portion 35*a* contacts the conductive layer 42*c* of the columnar portion 42, and electrons are supplied to the electron emission section through this contact portion.

The similar action and effects as those in the third embodiment can be obtained by the electron emission element 4.

[Fifth Embodiment]

Figure 5:
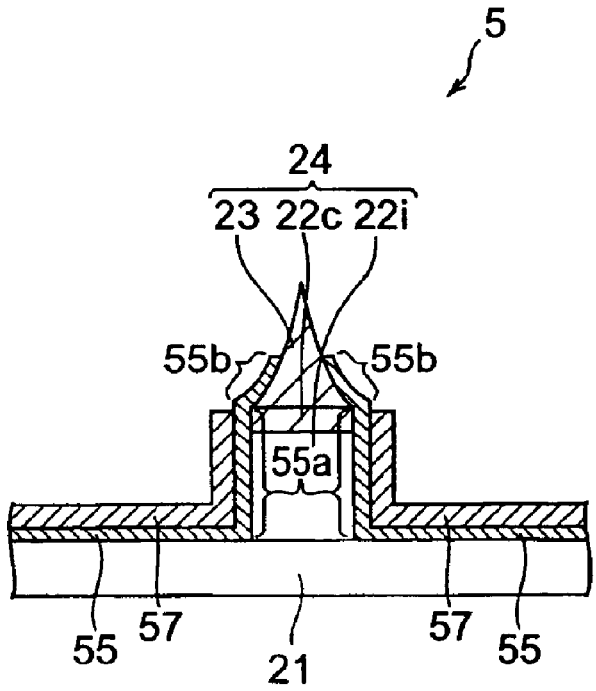
FIG. 5 is a vertical cross-sectional view of an electron emission element 5 according to a fifth embodiment of the present invention (Only one protrusion is shown for simplification)

The structure of an electron emission element 5 according to a fifth embodiment of the present invention will be described. FIG. 5 shows a vertical cross-sectional view of the electron emission element 5. Only one protrusion is shown for simplification. The structures of the substrate 21 and the protrusion 24 for the electron emission element 5 are the same as those in the second embodiment.

A first cathode electrode film 55 composed of Au, having a film thickness of 500 Å is formed on the substrate 21, and extends to the middle of the tip portion 23. In other words the cathode electrode film 55 covers the surface of the substrate 21, the entire side face of the columnar portion 22 and the lower side face of the tip portion 23. Further, a second cathode electrode film 57 made of W, having a film thickness of 4000 Å is formed on the first cathode electrode film 55 extending close to the boundary between the columnar portion 22 and the tip portion 23. Whereas, a conductive diamond (p-type semiconductor diamond) is exposed at the upper side face of the tip portion 23. Since the side face of the columnar portion 22 is at a substantial right angle to the surface of the substrate 21, the part (the emitter electrode portion 55*a*) of the first cathode electrode film 55 that covers the columnar portion 22 is also at a substantial right angle relative to the surface of the substrate 21. A part of the first cathode electrode film 55 above the emitter electrode portion 55*a* is a tilted electrode end 55*b* that inclines inward along the shape of the tip portion 23. In addition, the intervals between the protrusions 24 are adjusted so that the area (the flat electrode portion 55*c* (not numbered in FIG. 5)) of the first cathode electrode film 55 that covers the surface of the substrate 21 is larger than the area of the emitter electrode portion 55*a* and the tilted electrode end 55*c*.

An anode electrode A (not shown) is located above the electron emission element 5, facing the tip portion 23. When a negative voltage is applied to the cathode electrode film, electrons are supplied from the emitter electrode portion 55*a* (the portion contacting the conductive layer 22*c*) and the tilted electrode end 55*c* to the protrusion 24. When the electrons reach the spicular tip of the tip portion 23, they are externally emitted by the electric field between the anode electrode A and the tip portion 23.

Next, the action and effects by the electron emission element 5 will be described. The same action and effects as those in the third embodiment can be obtained by the electron emission element 5. Furthermore, since the first cathode electrode film 55 is thin as 500 Å, etching to a desirable shape is easy. On the other hand, disconnection tends to occur in the first cathode electrode film 55 due to the film being thin, however, the thick second cathode electrode film 57 electrically connects the disconnected part.

Next, a method for manufacturing electron emission element 5 will be described. Here, this manufacturing method is also an applied manufacturing method of the electron emission elements 1 to 4.

Upon manufacturing an electron emission element composed of diamond, it is important that a conductive layer for receiving the supplied electrons be formed close to the electron emission section, and that an acute point for effective provision of electron emission be formed. As a method for forming a conductive layer, for example, a diamond is synthesized to W or Si with a very sharp end. However, with this method, the sharpness is reduced. This is the same with synthesizing diamond to a sharp diamond, in which deterioration of the sharpness occurs. On the other hand, when a conductive layer is formed by ion injection to a sharp diamond protrusion, the sharpness is reduced during this process.

For overcoming above-described problems, the present inventor found that with the following manufacturing method, diamond protrusions with sharp ends can be realized together with the formation of conductive layers. Specifically, by doping p-type impurities or n-type impurities in the diamond substrate, or by injecting metal ions into the diamond substrate, a conductive layer is formed within the surface of a diamond substrate. Thereafter, the diamond substrate is etched to form diamond protrusions that include a conductive layer. Excessive doping of semiconductor impurities or metal ions causes many defects in the diamond crystal structure, which makes the formation of the acute structure difficult. The present inventor found that the problems in forming the acute structure is avoided when doping is performed with an impurity concentration of 2% or less and a metal element concentration of 10% or less.

Figure 6A:
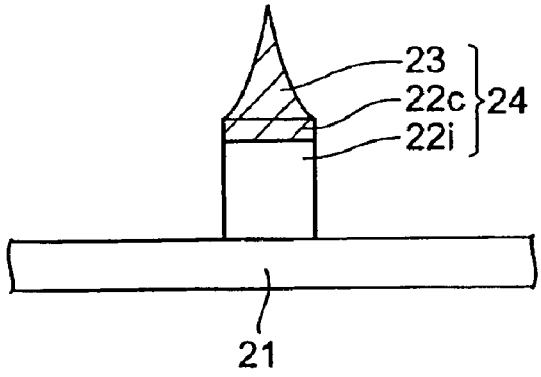
FIGS. 6A through 6C are diagrams (I) showing the manufacturing process of the electron emission element 5 according to the fifth embodiment of the invention.

FIGS. 6A through 6C, 7A through 7C and 8A and 8C are diagrams showing the process of manufacturing electron emission element 5. A concrete manufacturing method will be described hereunder. A conductive layer formed on the surface of a diamond substrate by doping with boron is prepared, and a dot pattern of Al is formed on the surface. The diamond substrate may be formed with polycrystal diamonds. In this case it is preferable that Al is aligned perpendicular to the substrate, and most preferable, when aligned within the plane of the substrate too. The diamond substrate is etched together with the conductive layer. Thereafter Al is removed. By this process a minute cylinder is formed on the substrate. The plasma process is performed for the minute cylinder, including the conductive layer, and the tip is sharpened. FIG. 6A shows a minute cylinder with a sharp end, formed on a diamond substrate.

Figure 6B:
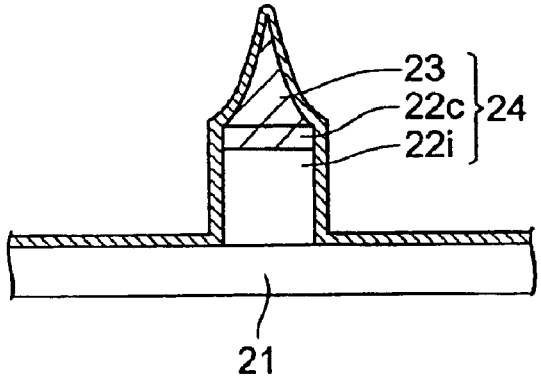

A 500 Å thick Au film is formed on the diamond substrate with minute cylinders having sharp ends. Further, in the case inclination of the side face of the minute cylinder relative to the flat portion of the substrate is 90° or more, sputtering method is more appropriate than the vapor deposition method for forming a metal film. The substrate on which an Au film is formed is shown in FIG. 6B.

Figure 6C:
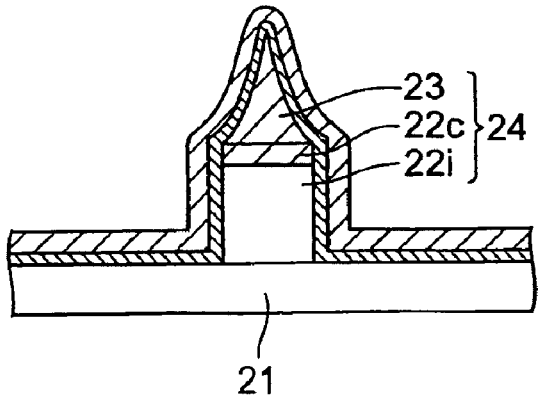

A 4000 Å thick W film is formed on the Au film. The substrate whereon the W film is formed is shown in FIG. 6C.

Figure 7A:
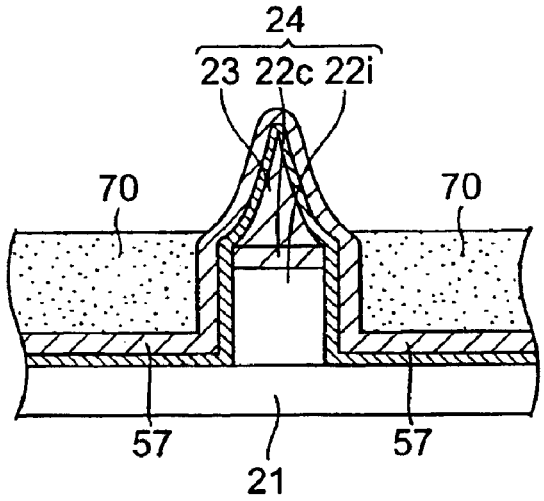
FIGS. 7A through 7C are diagrams (II) showing the manufacturing process of the electron emission element 5 according to the fifth embodiment of the invention.

Resist is coated onto W film 57, and by controlling the viscosity of the resist and the rotation number, a resist film 70 is so formed that the protrusion 24 exposes close to the boundary between the columnar portion 22 and the tip portion 23. The state wherein the resist film 70 is formed is shown in FIG. 7A.

Figure 7B:
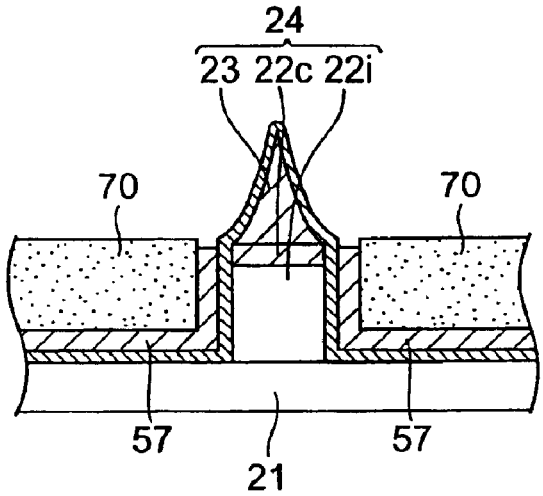
Figure 7C:
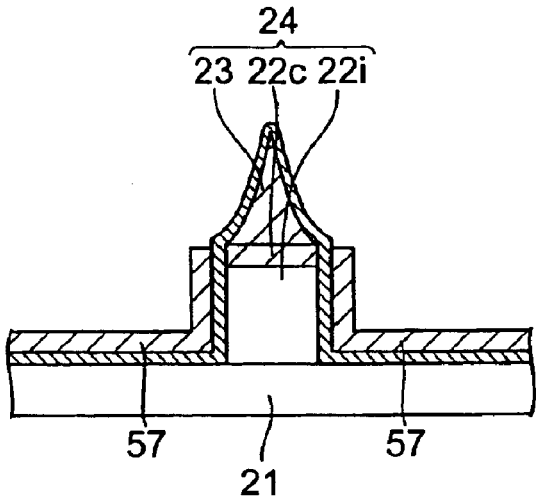

The W film is etched by use of a BHF (buffered hydrofluoric acid) solution or a 1% diluted HF solution, and the resist film 70 is removed. The state wherein the W film is etched is shown in FIG. 7B and that wherein the resist film 70 is removed is shown in FIG. 7C.

Figure 8A:
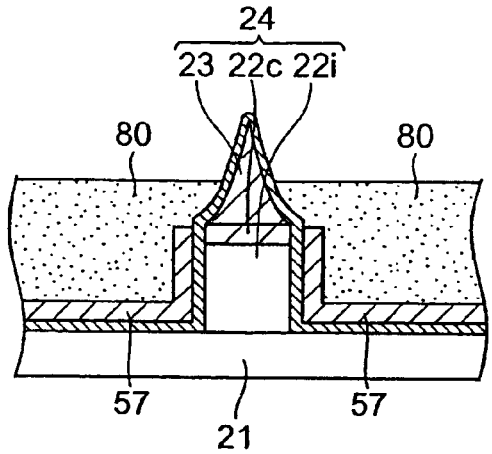
FIGS. 8A through 8C are diagrams (III) showing the manufacturing process of the electron emission element 5 according to the fifth embodiment of the invention.

After the Au film is exposed in this manner, a resist coating is applied onto the W film and the Au film. Further, by controlling the viscosity of the resist and the rotation number, a resist film 80 is formed so that the protrusion 24 is exposed from the middle of the tip portion 23. The state wherein the resist film 80 is formed is shown in FIG. 8A.

Figure 8B:
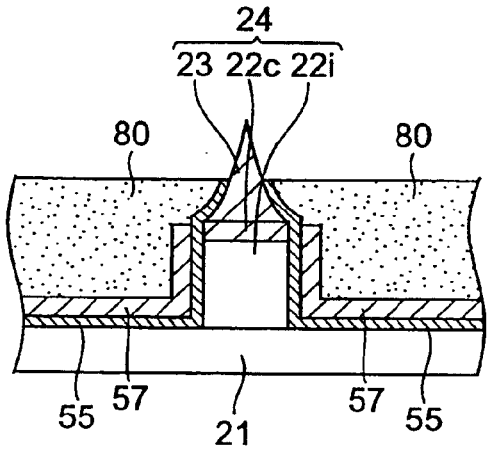
Figure 8C:
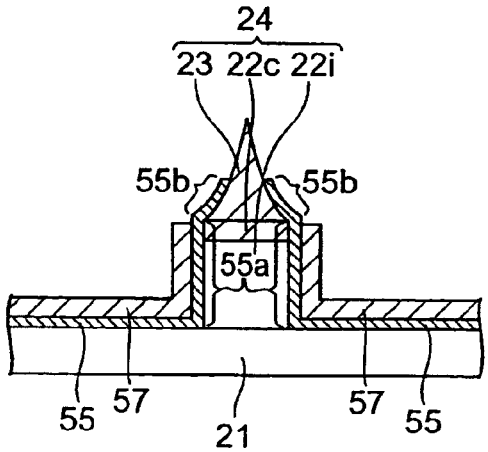

The Au film is etched by use of aqua regia (nitric acid:hydrochloric acid; 1:3) and thereafter the resist film 80 is removed. The state of the etched Au film is shown in FIG. 8B. FIG. 8C shows the state wherein the resist film 80 has been removed, and the electron emission element 5 completed.

EXAMPLES

The present invention will be described more specifically by referring to the following examples. However, the present invention is not limited to these examples.

First Example

A first example with the method for forming a protrusion and a cathode electrode film will be described. First, a mask with minute Al dots was fabricated on a single crystal diamond Ib(100) substrate by using photolithography technique. Then, the resultant substrate was etched, using the RIE technique, in a $CF_4/O_2$ gas (a $CF_4$ density of 1 to 3%) atmosphere, under a pressure of 2 Pa and electrical power of 200 W, for 0.5 to 1 hour, here a minute cylinder was formed on the diamond.

Figure 12:
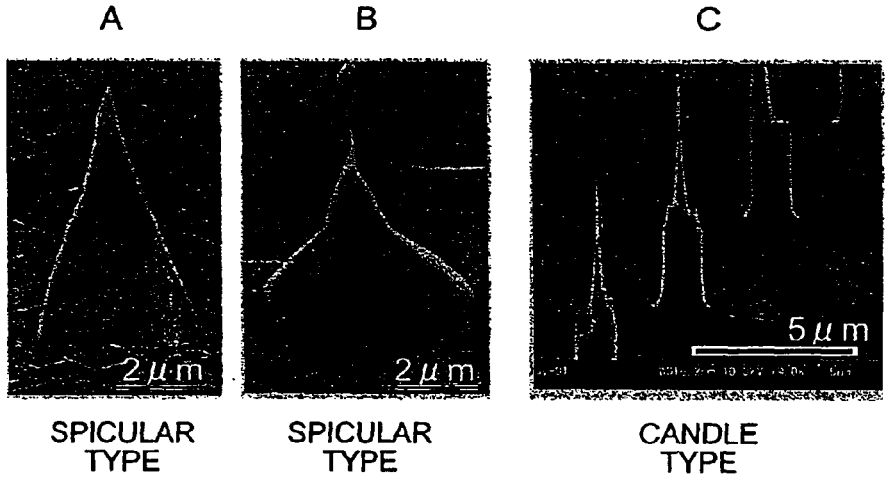
FIGS. 12A through 12C are pictorial image drawings showing a sharp protrusions (before an Al coated portion is formed) according to a first example of the present invention.

After the Al was removed, the diamond substrate with minute cylinder formed thereon was processed for approximately two hours in a microwave plasma of $CO_2/H_2$ gas ($CO_2$ concentration of 0.5%), under the condition of 400 W electrical power, a substrate temperature of 1050° C. and a pressure of 100 Torr. As a result, a base having a shape correlated to the plane orientation of a single crystal and the spicular tapered protrusion with an acute end was obtained (the inclination of the side face of the truncated pyramid being the base, against the surface of the substrate, is 60° or more). The spicular type protrusions are shown in FIGS. 12A and 12B.

Further, in the case RIE was performed until Al disappeared without removing Al in the previous process, a sharp candle shaped protrusion with an acute end was obtained. The sharp candle type protrusion is shown in FIG. 12C.

Then, using the sputtering method, an Al film was formed across the entire face of the substrate whereon the sharp protrusion was formed. With the use of the sputtering method instead of the vacuum evaporation method, Al film was formed on the perpendicular face of the protrusion, with the same thickness as that formed on the flat portion. Further, the protrusion figures were maintained by keeping appropriate intervals between the protrusions even after Al film was formed.

Figure 13:
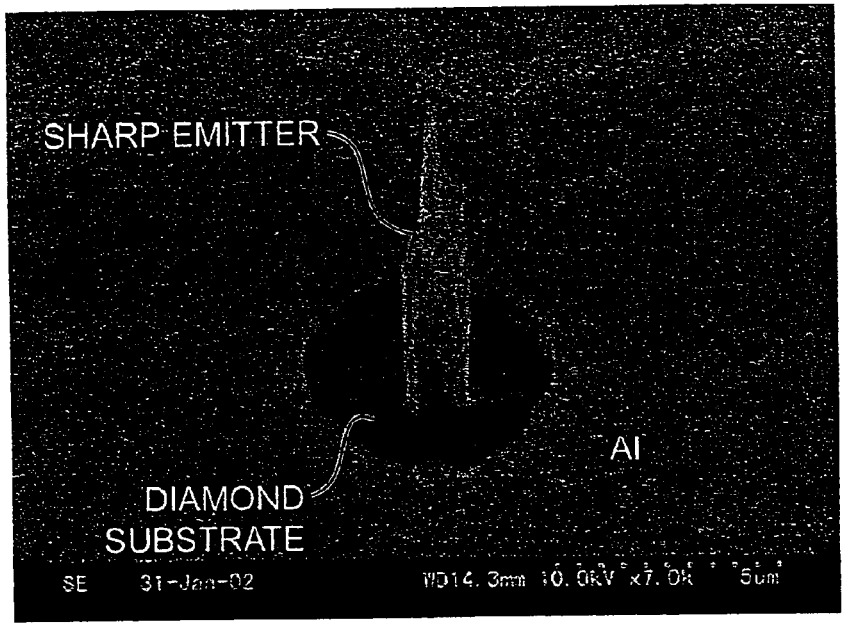
FIG. 13 is a pictorial image drawing showing a comparison example wherein the sharp protrusion in the first example is excessively etched.

Thereafter, spincoating of the resist was performed. The viscosity of the resist and the rotation velocity were controlled, so that a predetermined thickness could be obtained for the resist for the tip of the protrusion to be exposed. After the resist was post-baked, an alkaline solution was used to remove the Al film at the tip of the protrusion. Here, wet etching must be controlled in order to obtain a desired height of the Al film (metal electrode). A comparison example wherein excessive etching was performed is shown in FIG. 13.

Etching of the metal film made of Ti, W or Mo in the same manner was confirmed to be possible by use of an acid solution. This was possible because the material used in the underlayer of the metal film was diamond, a material that resists acid and alkaline.

Figure 14:
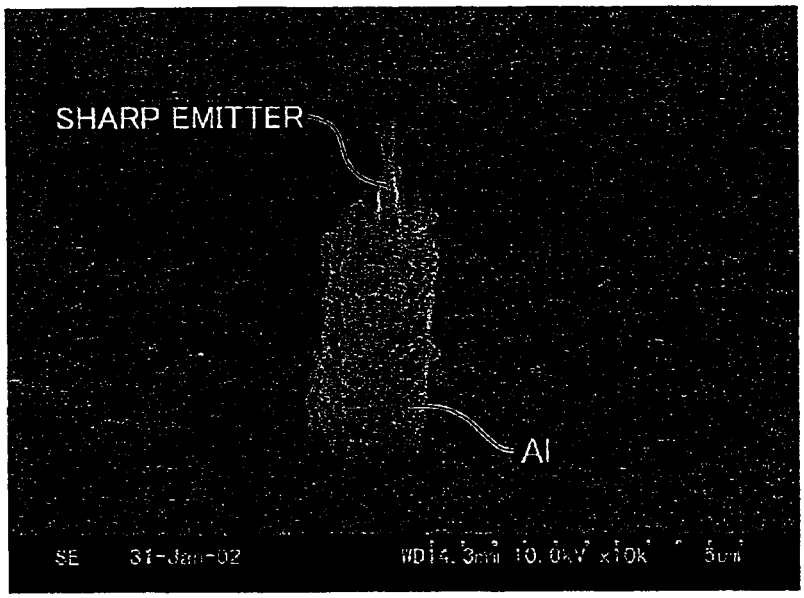
FIG. 14 is a pictorial image drawing showing the sharp protrusion (after an Al coated portion is formed) according to the first example.

A protrusion with an acute end together with surrounding metal electrodes formed, was obtained by removing resist with organic solvent and processing with pure water. The completed protrusion is shown in FIG. 14.

Second Example

A second example on a method for forming a protrusion including a metal ion injected layer will be described. A conductive layer was formed by injecting metal ions into a diamond substrate. The depth of the metal ion injected layer was adjusted to 0.1 to several $\mu$m. The surface became a thin diamond layer or a fractured crystal diamond layer.

Figure 15:
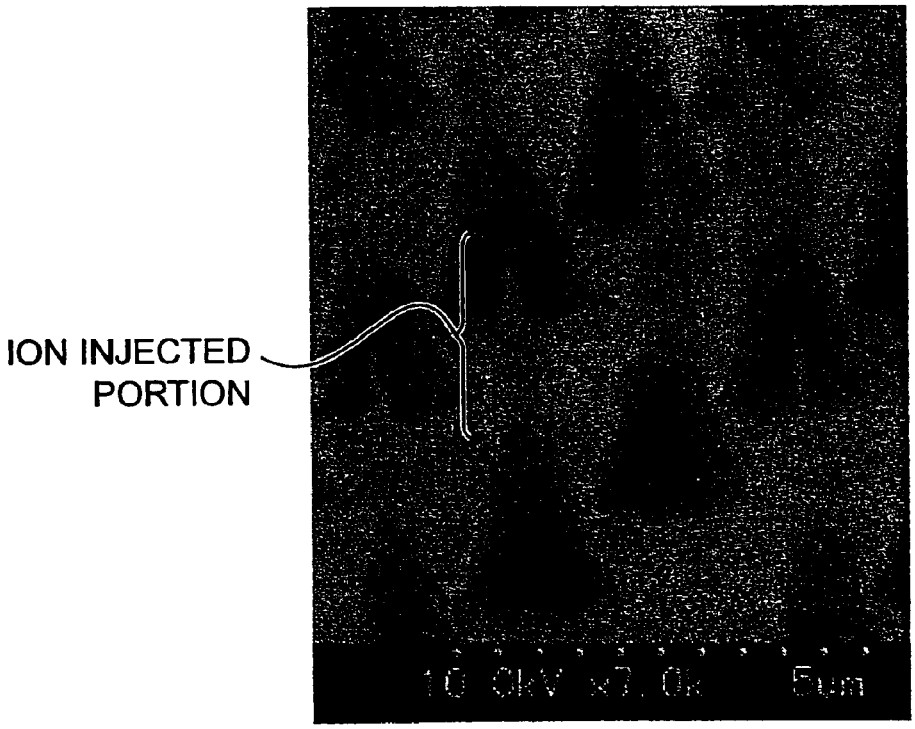
FIG. 15 is a pictorial image drawing showing a sharp protrusion, including a metal ion injected layer, according to a second example.

As long as the quantity of metal ions injected into the substrate was 10% or less, a sharp protrusion was formed using the same method as that used for the first example. The sharp protrusion including the metal ion injected layer is shown in FIG. 15.

Figure 16:
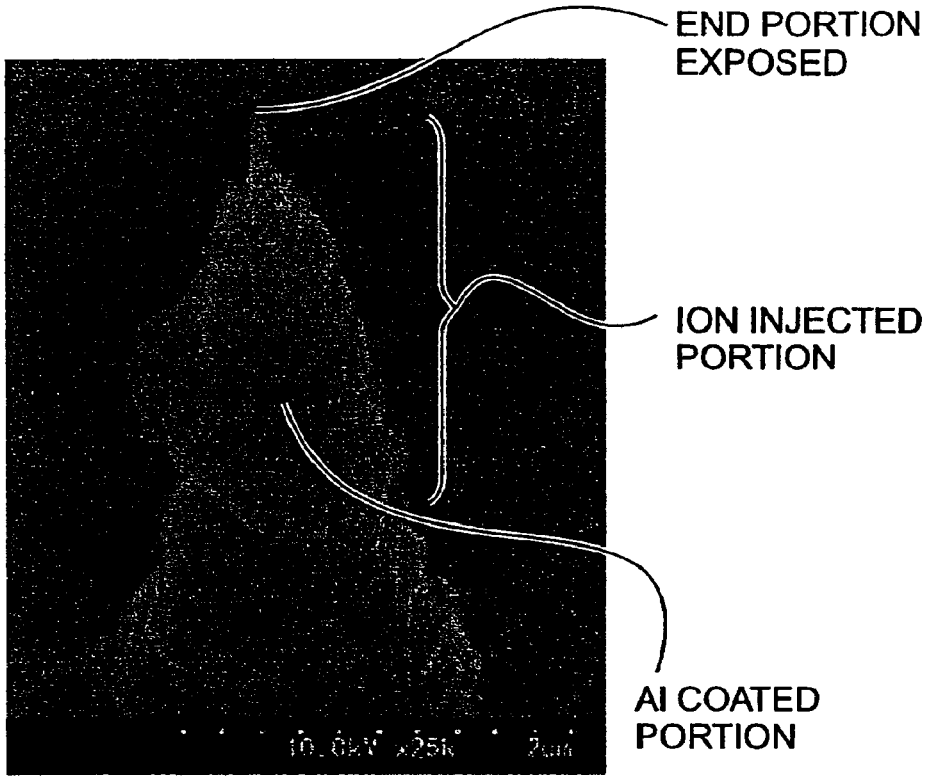
FIG. 16 is a pictorial image drawing showing the sharp protrusion (after an Al coated portion is formed) according to the second example.

Furthermore, an Al coated portion was formed around the sharp protrusion using the same method as that used for the first example. The sharp protrusion wherein the Al coated portion is formed is shown in FIG. 16.

Figure 19:
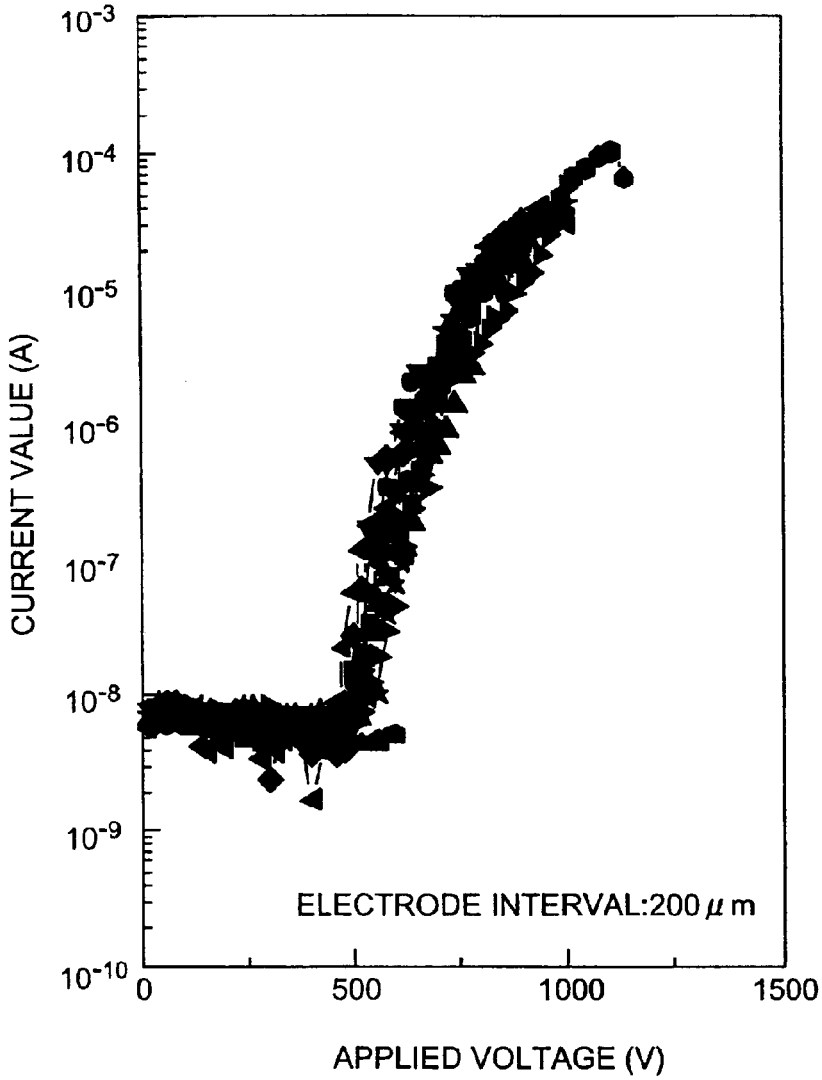
FIG. 19 is a graph showing the characteristic between the applied voltage (electrode interval of 200 μm) and the emission current of the electron emission element according to the second example.

FIG. 19 is a graph showing the characteristic between the applied voltage (electrode interval of 200 $\mu$m) and the emission current of the electron emission element for the second example. Very satisfactory values were obtained, that is, the threshold voltage value was 500 V, in other words, the average threshold electric field intensity was 2.5 V/$\mu$m.

Third Example

An explanation will be given for a third example of a method for forming a protrusion that includes an impurity containing layer. A diamond film containing a dopant element, such as boron or phosphorus, was synthesized on a diamond substrate. The surface was made a conductive layer by dopant element. It was appropriate for the doped layer to be 0.1 to several $\mu$m thick, in order to control the height of the exposed end from the Al coated portion. Obviously, there is no upper limit for the thickness, however, an appropriate thickness is set to reduce the synthesis period.

Figure 17:
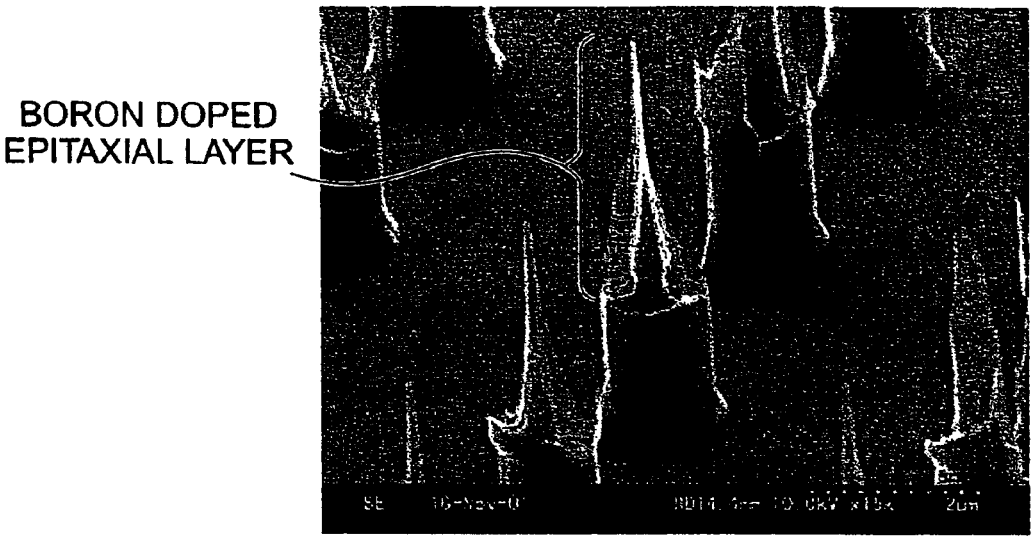
FIG. 17 is a pictorial image drawing showing a sharp protrusion, including an impurity containing layer, according to a third example.

Even if a diamond containing dopant material is formed, as long as the doping concentration is 10% or less, a sharp protrusion was formed with the same method as that used for the first example. An example of a sharp protrusion including an impurity containing layer, is shown in FIG. 17.

Figure 18:
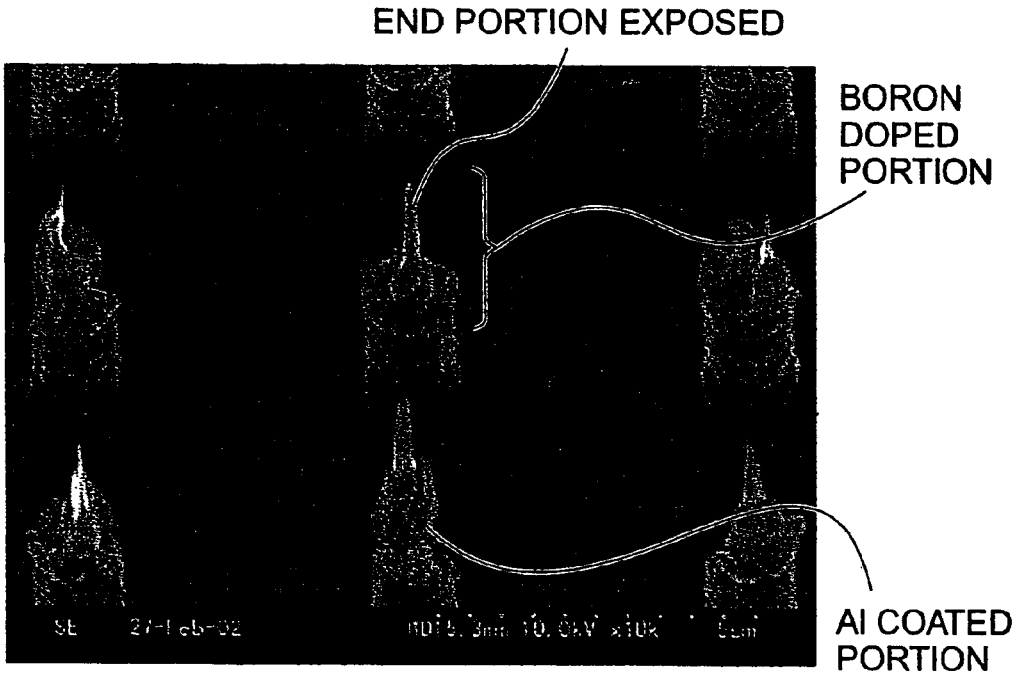
FIG. 18 is a pictorial image drawing showing the sharp protrusion (after an Al coated portion is formed) according to the third example.

Furthermore, an Al coated layer was formed around the sharp protrusion using the same method as that used for the first example. The protrusion whereon the Al coated portion was formed is shown in FIG. 18.

Figure 20:
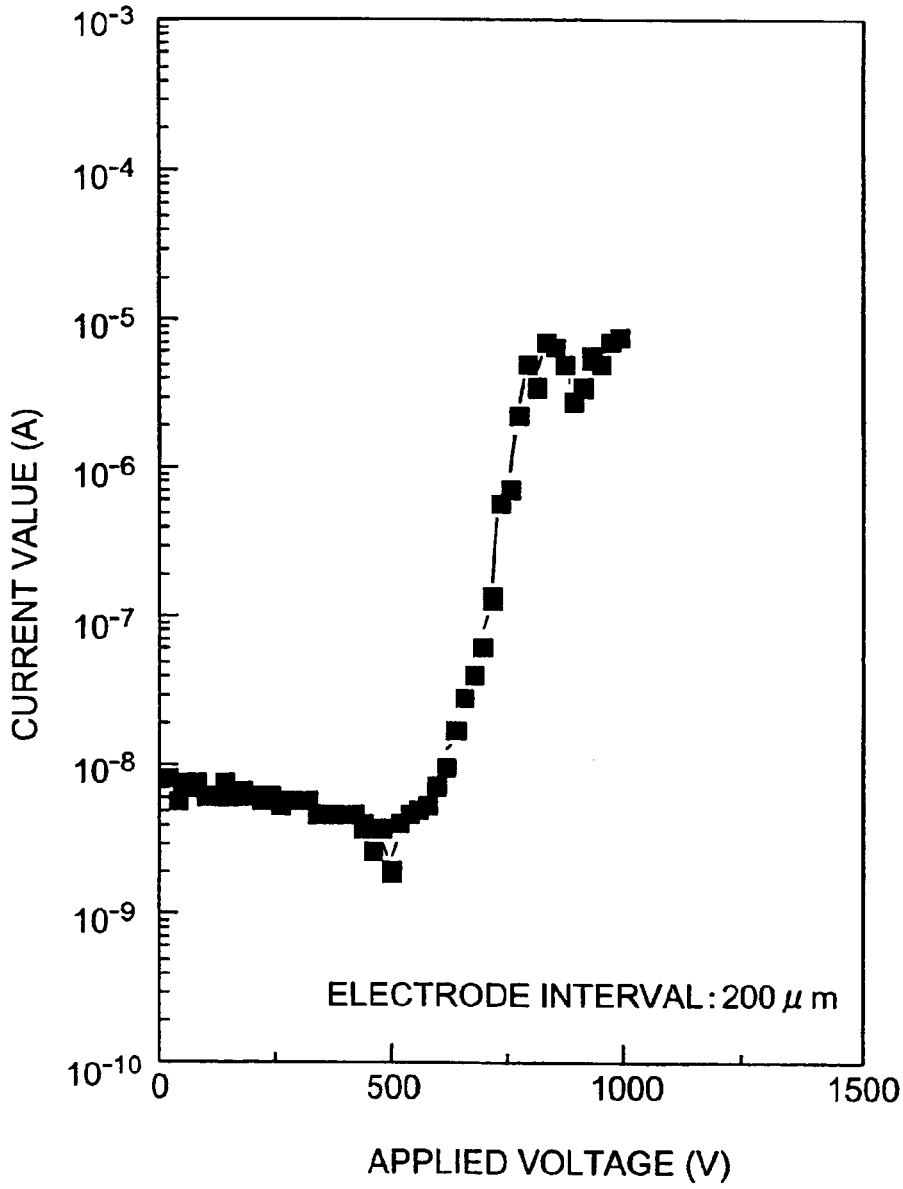
FIG. 20 is a graph showing the characteristic between the applied voltage (electrode interval of 200 μm) and the emission current of the electron emission element according to the third example.

FIG. 20 is a graph showing a characteristic between the applied voltage (electrode interval of 200 $\mu$m) and the emission current of the electron emission element for the third example, wherein an epiboron doped layer is formed. Very satisfactory values were obtained, that is, the threshold voltage value was 700 V, in other words, the average threshold electric field intensity was 3.5 V/$\mu$m.

[Sixth Embodiment]

Figure 10A:
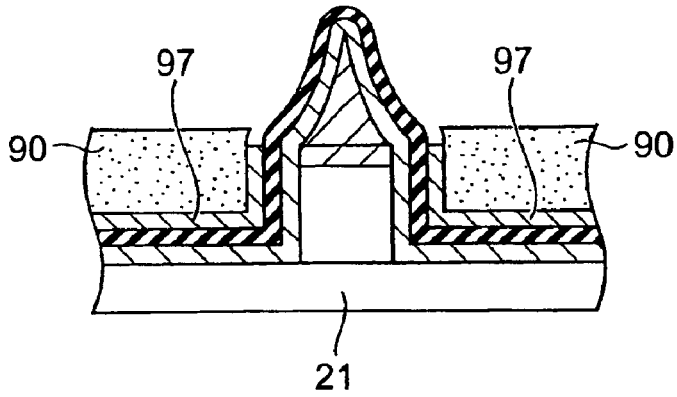
FIGS. 10A through 10C are diagrams (II) showing the manufacturing process of the electron emission element 6 according to the sixth embodiment of the invention.
Figure 10B:
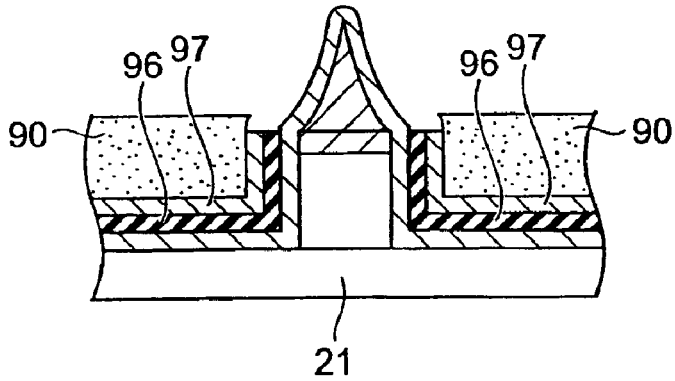
Figure 10C:
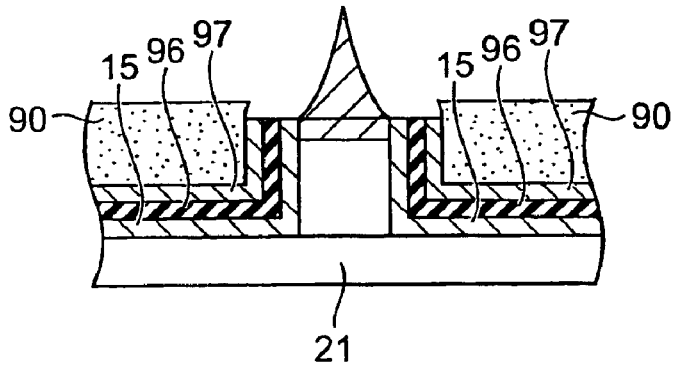
Figure 11:
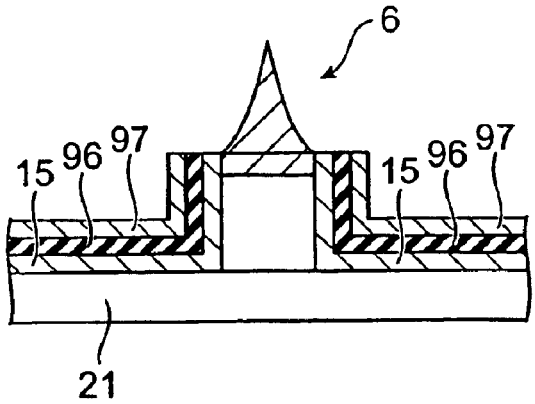
FIG. 11 is a vertical cross-sectional view of the electron emission element 6 according to the sixth embodiment of the invention (Only one protrusion is shown for simplification)

The structure of an electron emission element 6 according to a sixth embodiment of the present invention will be described. FIG. 11 shows a vertical cross-sectional view of the electron emission element 6. Only one protrusion is shown for simplification. The structures of a substrate 21, a protrusion 24 (reference number is omitted in FIGS. 9B, 9C, 10A–10C and 11) and a cathode electrode film 15 of the electron emission element 6 are the same as those in the second embodiment.

The cathode electrode film 15, an insulation film 96 and a second electrode film 97 are laminated on the substrate 21 in the named order. Cathode electrode film 15, insulation film 96 and second electrode film 97 each extends close to the boundary between a columnar portion 22 and a tip portion 23 (reference numbers are omitted in FIGS. 9B, 9C, 10A–10C and 11).

Next, actions and effects by the electron emission element 6 will be described. The same actions and effects can be obtained for electron emission element 6 as that for the second embodiment. Furthermore, the second electrode film 97 can be utilized as a gate electrode for controlling the thickness of a depletion layer in the tip portion 23 and a conductive layer 22*c*. Also, by making the second electrode film 97 an anode, the electron emission element 6 can be applied as an electron emission element whose cathode and anode are located extremely close to each other.

Next, a method for manufacturing the electron emission element 6 will be explained. FIGS. 9A through 9C and 10A through 10C are diagrams showing the manufacturing process of the electron emission element 6.

Figure 9A:
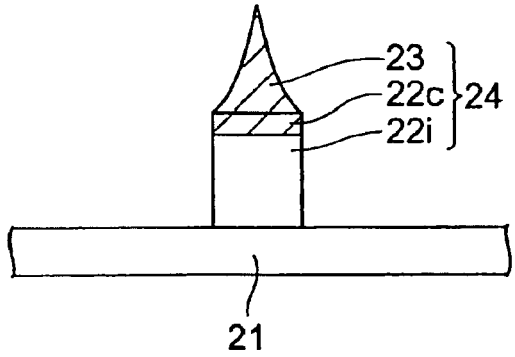
FIGS. 9A through 9C are diagrams (I) showing the manufacturing process of the electron emission element 6 according to a sixth embodiment of the invention.
Figure 9B:
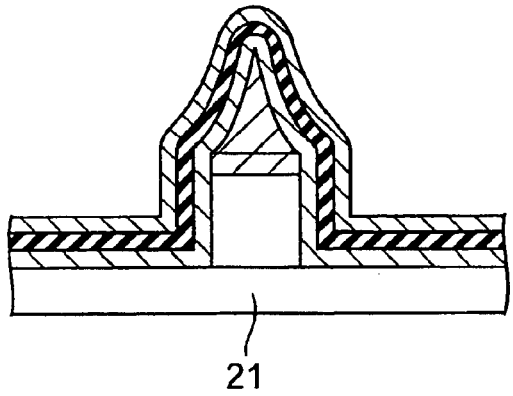

A first metal film, an insulation film and a second metal film are formed in the named order on the diamond substrate 21 with the protrusion 24 that is shown in FIG. 9A. The state wherein the first metal film, the insulation film and the second insulation film are formed in the named order is shown in FIG. 9B.

Figure 9C:
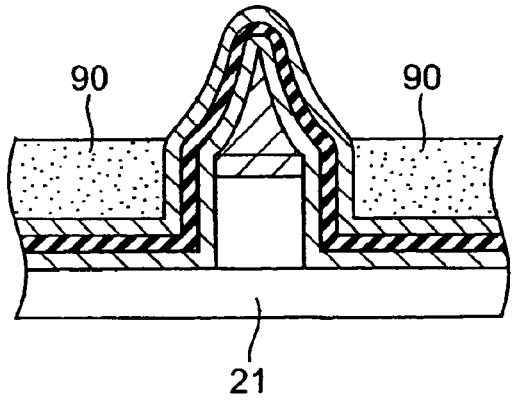

A resist is coated on the second metal film, and by controlling the viscosity of the resist and the rotation number, resist film 90 is formed so that the protrusion 24 is exposed close to the boundary between the columnar portion 22 and the tip portion 23. The state wherein the resist film 90 is formed is shown in FIG. 9C.

The second metal film, the insulation film and the first metal film are etched in the order of precedence. The state wherein the second metal film, the insulation film and the first metal film have been etched is shown in FIGS. 10A through 10C.

The electron emission element 6 is completed after the resist film 90 is removed.

As is described above, according to the present invention, an electron emission element with efficient supply of electrons from the cathode electrode film to the electron emission section can be provided.

What is claimed is:

1. An electron emission element comprising, a substrate, and a plurality of protrusions, composed of diamond, protruding from the substrate:

wherein each of the protrusions comprises, a tip portion, having a sharp end, which is located at the top end of the protrusion, and a columnar portion, the side face of which extends upward relative to the surface of the substrate, and which is located below the tip portion; and wherein side face of each of the columnar portions of the protrusions is provided with a cathode electrode film, which is electrically connected to a conductive layer included in the protrusion.

2. The electron emission element according to claim 1, wherein the surface of the substrate and the side faces of the columnar portions form angles of not less than 78 degrees.

3. The electron emission element according to claim 1, wherein the surface of the substrate and the side faces of the columnar portions form substantial right angles.

4. The electron emission element according to claim 1, wherein the cathode electrode film covers both the protrusions and the surface of the substrate, and wherein the area of the portion of the cathode electrode film that covers the surface of the substrate is larger than the area covering the protrusions.

5. The electron emission element according to claim 1, wherein the cathode electrode film covers entire side faces of the columnar portions.

6. The electron emission element according to claim 1, wherein at least part of the conductive layer is included in the tip portion.

7. The electron emission element according to claim 1, wherein the conductive layer is formed by injecting metal ions into diamond.

8. The electron emission element according to claim 1, wherein the conductive layer is composed of diamond containing impurities.

9. The electron emission element according to claim 1, wherein the cathode electrode film comprises, a first cathode electrode layer that contacts the conductive layer, and a second cathode electrode layer that is formed on the first cathode electrode layer and that is thicker than the first cathode layer.

10. The electron emission element according to claim 1, wherein an insulation film is formed on the cathode electrode film, and wherein a second electrode film is formed on the insulation film.

* * * * *